US010513277B2

(12) United States Patent
Aisa

(10) Patent No.: US 10,513,277 B2
(45) Date of Patent: Dec. 24, 2019

(54) METHOD FOR MANAGING A RAILWAY ELECTRICAL CIRCUIT

(71) Applicant: ALSTOM Transport Technologies, Saint-Ouen (FR)

(72) Inventor: Pier-Alessandro Aisa, Bologne (IT)

(73) Assignee: ALSTOM TRANSPORT TECHNOLOGIES, Saint-Ouen (FR)

( * ) Notice: Subject to any disclaimer, the term of this patent is extended or adjusted under 35 U.S.C. 154(b) by 0 days.

(21) Appl. No.: 15/590,608

(22) Filed: May 9, 2017

(65) Prior Publication Data

US 2017/0327137 A1 Nov. 16, 2017

(30) Foreign Application Priority Data

May 12, 2016 (EP) ..... 16305556

(51) Int. Cl.
*G08G 1/123* (2006.01)
*B61L 23/04* (2006.01)
(Continued)

(52) U.S. Cl.
CPC ..... *B61L 23/04* (2013.01); *B61L 1/165* (2013.01); *B61L 1/167* (2013.01); *B61L 1/18* (2013.01)

(58) Field of Classification Search
CPC .. B61L 1/165; B61L 1/167; B61L 1/18; B61L 1/02; B61L 1/025; B61L 1/181; B61L 1/182; B61L 1/188; B61L 23/04; B61L 23/14; B61L 23/16; B61L 23/161; B61L 13/00; B61L 13/002; B61L 13/04; B61L 13/042; B61L 27/0061; B60M 1/08; B60M 1/02; B60M 1/10
See application file for complete search history.

(56) References Cited

U.S. PATENT DOCUMENTS 1,626,643 A * 5/1927 Stolp ..... B61L 1/185 246/28 E
3,868,075 A * 2/1975 Blazek ..... B61L 23/168 246/34 CT
(Continued)

FOREIGN PATENT DOCUMENTS

JP 2016016731 A 2/2016
RU 2433929 C2 11/2011
RU 2508215 C1 1/2014

*Primary Examiner* — Quang Pham
(74) *Attorney, Agent, or Firm* — B. Aaron Schulman, Esq.; Stites & Harbison, PLLC

(57) ABSTRACT

A method is provided for detecting the presence of a rolling stock on a railway track that is subdivided in successive track sections forming successive electrical circuits independently fed with electrical current for monitoring the presence of a rolling stock on a track section. A transmission device for providing electrical current is located at one end of the track section, and a reception device for detecting the electrical current is located at an opposite end of the track section. This method includes steps for continuously feeding the electrical circuit with electrical current and monitoring the presence of a rolling stock on the corresponding track section so that an electrical current can be applied to the electrical circuit if the reception device detects that no rolling stock is present on the track section. A system for detecting presence of a rolling stock on a railway track is also provided.

10 Claims, 2 Drawing Sheets

(51) Int. Cl.
*B61L 1/16* (2006.01)
*B61L 1/18* (2006.01)

(56) References Cited

U.S. PATENT DOCUMENTS 4,652,986 A * 3/1987 Kolkman ..... H02M 7/48 361/87
5,330,134 A * 7/1994 Ehrlich ..... B61L 1/188 246/34 B
5,330,135 A * 7/1994 Roberts ..... B61L 1/187 246/122 R
5,666,382 A * 9/1997 Thakore ..... B61L 3/24 348/384.1
8,540,192 B2 * 9/2013 Basso ..... B61L 29/284 246/114 R
9,061,691 B2 * 6/2015 Ernst ..... B61L 1/06
2002/0113170 A1 * 8/2002 Grappone ..... B61L 23/041 246/120
2004/0181321 A1 * 9/2004 Fries ..... B61L 1/187 701/19
2007/0132463 A1 * 6/2007 Anderson ..... B61L 1/181 324/713
2008/0067293 A1 * 3/2008 Fries ..... B61L 1/181 246/293
2008/0105791 A1 * 5/2008 Karg ..... B61K 9/10 246/120
2008/0142645 A1 * 6/2008 Tomlinson ..... B61L 1/181 246/122 R
2011/0147535 A1 * 6/2011 Aisa ..... B61L 1/187 246/122 R
2011/0174934 A1 * 7/2011 Kikuchi ..... B61L 1/187 246/122 R
2011/0284697 A1 * 11/2011 Altamura ..... B60M 3/02 246/4
2012/0067684 A1 * 3/2012 Asplund ..... B60L 5/40 191/22 C
2013/0015296 A1 * 1/2013 Maurizio ..... B61L 1/188 246/122 R
2013/0264430 A1 * 10/2013 Ernst ..... B61L 1/06 246/122 R
2014/0041980 A1 * 2/2014 Noffsinger ..... B61L 1/181 191/45 R
2014/0124628 A1 * 5/2014 Tresanini ..... B61L 3/246 246/194
2015/0158510 A1 * 6/2015 Fries ..... B61L 1/181 701/19
2016/0096540 A1 * 4/2016 Cipollone ..... B61L 25/025 701/19
2016/0152251 A1 * 6/2016 Aisa ..... B61L 1/187 246/121
2016/0176420 A1 * 6/2016 Aisa ..... B61L 1/187 246/219

* cited by examiner

METHOD FOR MANAGING A RAILWAY ELECTRICAL CIRCUIT

FIELD OF THE INVENTION

The invention relates to a method for managing a railway electrical circuit.

BACKGROUND OF THE INVENTION

On railway tracks, presence of trains can be monitored by inducing circulation of electrical current within the rails in order to detect, by the variations of the properties of the electrical current, the presence of a train. Such a technique is generally implemented by subdividing the railway track in successive track sections which each form an electrical circuit, which is independently fed with electrical current. The electrical current in the parallel rails forms a closed loop, with electrical connections at each end of the railway track section adapted to connect the parallel rails to each other to close the electric loop. When a train enters the track section, conduction of electrical current in the metallic elements of the train, such as wheels and axles, provokes a short-circuit which prevents electrical current from circulating up to the end of the track circuit located on the side where the train is present. This induces a variation of the properties of the electrical current going in the electrical circuit, these variations denoting presence of a train on the railway track section.

However, such a technique implies that electrical current is continuously fed to the electrical circuit, whereas trains are effectively running on the tracks for a small amount of time. This induces electrical power overconsumption.

It is known, for example from US-A-2013/0264430, to limit the power consumption of wayside electrical equipments when no train is present on the railway track. When a train is detected as entering the track, the electrical circuit is fed with a nominal electrical current for feeding the wayside equipment such as signals or communication devices.

However, when a train enters a track section, the short circuit induced by the train provokes a rise of the power consumption of the track circuit, which increases until the train passes on the end of the track circuit where electrical power is fed to the circuit by a transmitter. This increasing power consumption provokes unnecessary power consumption.

BRIEF SUMMARY OF THE INVENTION

The aim of the invention is to provide a new method for managing a railway electrical circuit, in which the power consumption of the circuit when a train runs on a track section is better controlled.

To this end, the invention concerns a method for managing a railway electrical circuit adapted to detect presence of a rolling stock on a railway track, the railway track being subdivided in successive track sections forming successive electrical circuits independently fed with electrical current for monitoring the presence of a rolling stock on one of the track sections, each electrical circuit comprising a transmission device for feeding the electrical circuit with electrical current, located at one end of the track section, and a reception device for detecting the electrical current circulating in the electrical circuit, located at an opposed end of the track section, this method comprising steps consisting in:

a) continuously feeding the electrical circuit with electrical current with the transmission device and monitoring the presence of a rolling stock on the corresponding track section by measuring, using the reception device, the current circulating in the electrical circuit;

b) if the reception device detects that a rolling stock is present on the track section, applying to the electrical circuit a nominal electrical power at least until the rolling stock exits the section;

c) if the reception device detects that no rolling stock is present on the track section, applying to the electrical circuit a power-saving power value which is inferior to the nominal power.

This method is characterized in that at step b) the electrical power consumed by the electrical circuit is kept under a limited value.

Thanks to the invention, the overall power consumption of a group of track sections is reduced.

According to further aspects of the invention which are advantageous but not compulsory, such a method may incorporate one or several of the following features:

The limited value is chosen inferior to a maximal value that the power consumption of the electrical circuit would reach when the rolling stock passes the transmission device.

The limited power value is inferior to 70%, preferably inferior to 50%, of the maximal power value.

The power-saving power value is set inferior to 70%, preferably inferior to 50% of an initial power value, the initial power value corresponding to the power consumed by the electrical circuit at the instant the reception device detects that a rolling stock is present on the track section, and the nominal electrical power is applied to the electrical circuit.

During step b) a delay is set when the rolling stock is detected as having exited the railway track section, and if the delay expires while no other rolling stock has been detected on the track section, step c) is executed.

The delay is adjustable.

The delay is superior to 30 seconds.

The delay is set to 1 minute.

During step c) the transmission device is commanded to apply a signal with a first predetermined tension to the electrical circuit, and during step b) the transmission device is commanded to apply a signal with a second predetermined tension, superior to the first predetermined tension, to the electrical circuit.

The invention also concerns a system for detecting presence of a rolling stock on a railway track, the railway track being subdivided in successive track sections forming successive electrical circuits, independently fed with electrical current for monitoring the presence of a rolling stock on one of the track sections, each electrical circuit comprising a transmission device for feeding the electrical circuit with electrical current, located at one end of the track section, and a reception device for detecting the electrical current circulating in the electrical circuit, located at an opposed end of the track section, the transmission device being adapted to continuously feed the corresponding electrical circuit with electrical current, the reception device being adapted to monitor the presence of a rolling stock on the corresponding track section by measuring the current circulating in the corresponding electrical circuit, the transmission device being adapted to apply to the corresponding electrical circuit a nominal electrical power if the corresponding reception device detects that a rolling stock is present on the corresponding track section, at least until the rolling stock exits the track section, the transmission device being adapted to apply to the corresponding electrical circuit a power-saving power value, which is inferior to the nominal power, if the corresponding reception device detects that no rolling stock is present on the track section. This system is characterized in that it comprises means to keep under a limited value the electrical power consumed by an electrical circuit when the nominal power is applied to this electrical circuit.

BRIEF DESCRIPTION OF THE DRAWING FIGURE

The invention will now be explained as an illustrative example, in reference to the annexed drawings in which.

DETAILED DESCRIPTION OF EXEMPLARY EMBODIMENTS

Figure 1:
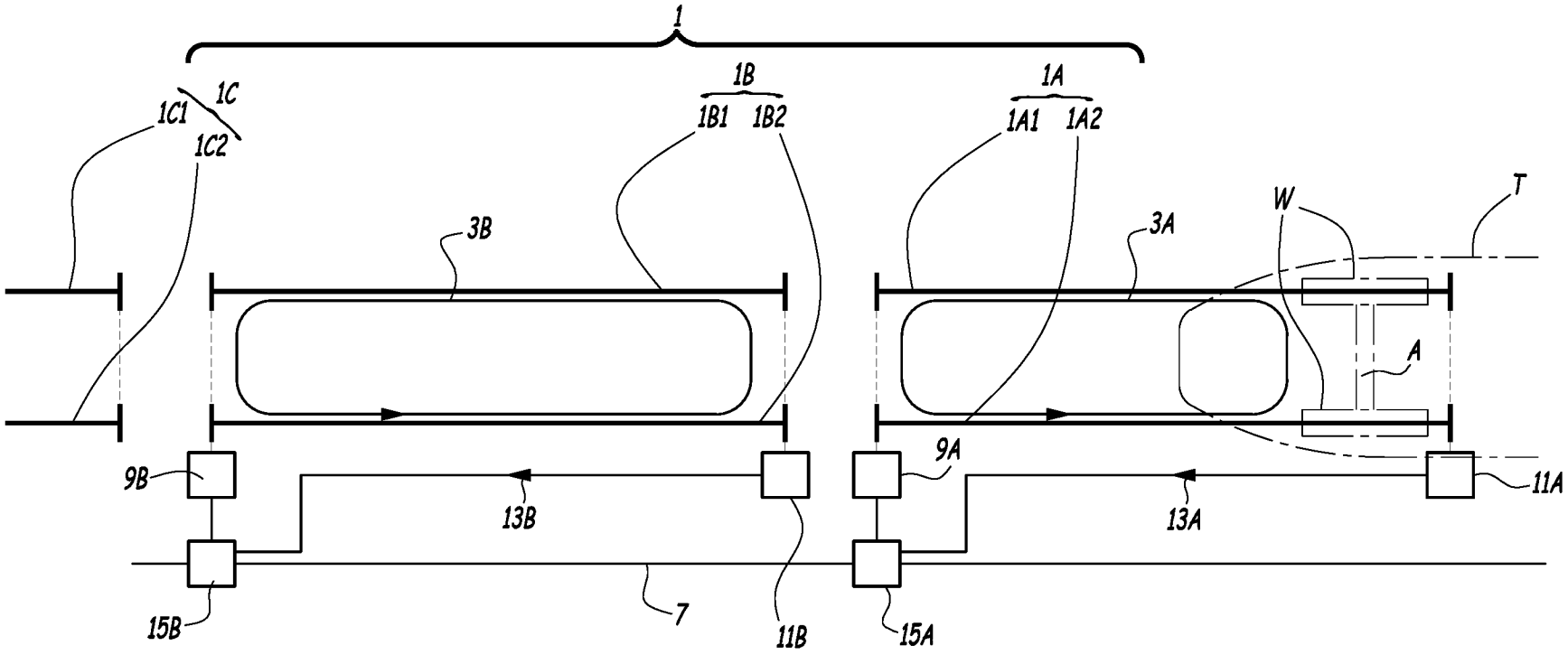
FIG. 1 is a diagram of a railway track circuit with which the method of the invention is implemented.

FIG. 1 shows a railway track 1, which is subdivided in track sections, of which two are represented with references 1A, 1B, a third section 1C being partly represented. The first section 1A is formed by two rails 1A1 and 1A2, the second section 1B is formed by two rails 1B1 and 1B2, and the third section 1C is formed by two rails 1C1 and 1C2. The sections 1A, 1B and 1C are represented as physically separated from each other. In practice, the rails of two successive track sections are electrically insulated from each other thanks to insulating parts which form mechanical joints. As a non-shown variant, the rails of the successive track sections may be formed as one piece, the track sections being only delimited by electrical means; this approach is known as joint-less track circuits.

Each of the track sections forms an electrical circuit which is fed with electrical current for monitoring the presence of a rolling stock, such as a train T, on the corresponding track section. Track section 1A forms an electrical circuit 3A, and the track section 1B forms an electrical circuit 3B. The electrical circuits 3A and 3B are respectively formed by the rails 1A1 and 1A2 and by the rails 1B1 and 1B2. The electrical circuits 3A and 3B comprise respectively at the ends of the rails 1A1 and 1A2 and 1B1 and 1B2, connection systems, represented by dashed lines, and which include electrical wires and other electrical systems. Each electrical circuit 3A and 3B is continuously fed with electrical current originating from a power line 7 which runs along the railway track 1. Each electrical circuit 3A and 3B comprises a transmission device 9A and 9B via which electrical current is fed to electrical circuits 3A and 3B. The transmission devices 9A and 9B are electrically connected to the rails 1A1, 1A2, 1B1 and 1B2.

The electrical circuits 3A and 3B also include a reception device 11A and 11B, which detects the electrical current circulating in the circuit 3A and 3B and which is located at an opposed end of the track section 1A or 1B with respect to the transmission devices 9A and 9B.

As an example, the reception devices 11A and 11B may be relays or coils adapted to be magnetized by current passing in the rails, to detect power cuts and to activate a signal. Alternatively, the reception devices 11A and 11B may be electronical devices adapted to implement computation with microprocessors.

In case a train T enters for example the track section 1A, the mechanical contact of the wheels W of the train with the rails 1A1 and 1A2, and the mechanical connection of the wheels W by an axle A, induces a short-circuit. The wheels W and the axle A are generally metallic, and the electrical current circulating in circuit 3A therefore mainly circulates in the train T which links the rails 1A1 and 1A2 to close the loop of electrical circuit 3A. The reception device 11A therefore detects a current whose properties, such as intensity, are much lower because of the resistance formed by the train T. Depending on the properties of the train T and of rust formed on the rails, a small amount of current may still reach reception device 11A. However, the reception device 11A is adapted to detect the current variations and emits a signal 13A, to be received by a non-shown control receiver, indicating that a train has entered the track section 1A.

When no train T is present on a track section, as it is the case for track section 1B, the reception device 11B emits a signal 13B which indicates that no train is running on the track section 1B.

As electrical current is continuously fed to the transmission devices 9A and 9B, the power consumption of the track section and notably of the electrical circuits 3A and 3B is quite high. Therefore, when no train is detected, the transmission devices 9A and 9B are commanded to deliver a minimal electrical power set to a power saving value P0.

In other words, the transmission device 9A is commanded to deliver a signal with a first predetermined tension applied to the track section 1A.

The power saving value P0 is the necessary power, in order that reception devices 11A and 11B detect the entrance of a train T on the corresponding track section. Therefore a free track electrical power PF is consumed by the electrical circuits 3A and 3B and is equal to the power saving value P0.

Figure 2:
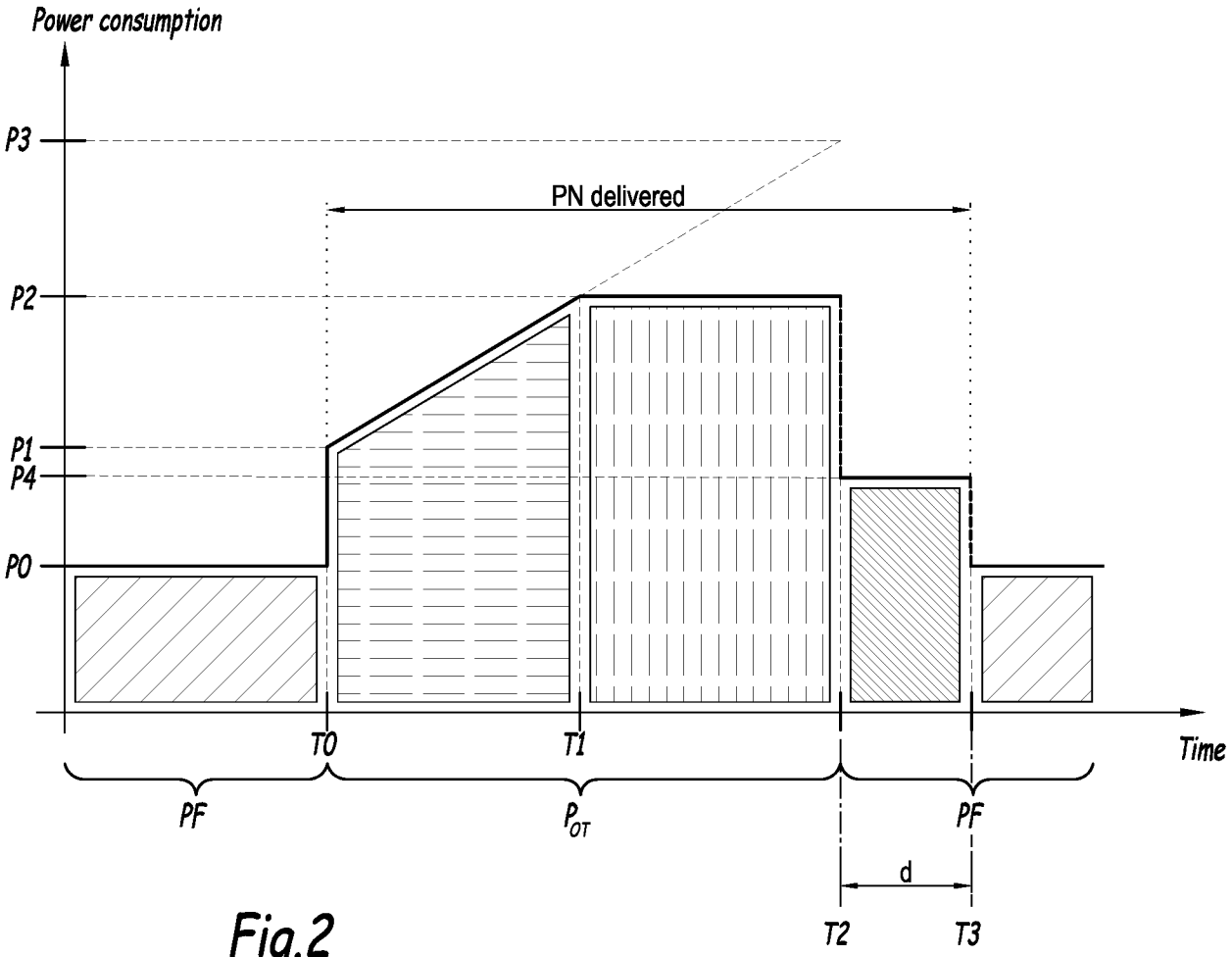
FIG. 2 is a time versus electrical power consumption chart illustrating the method of the invention.

In case one of the reception devices 11A and 11B, and for example the reception device 11A, measures an electrical current value that denotes that a train T is present on the corresponding track section, as shown at a time T0 on FIG. 2, the transmission device 9A is commanded to deliver a nominal electrical power PN corresponding to a signal with a second predetermined tension applied to the track section 1A, i.e. to the electrical circuit 3A. The second predetermined tension is superior to the first predetermined tension. The nominal electrical power PN is superior to the power saving value P0. The transmission device 9A is commanded to deliver the nominal electrical power PN at least until the train T exits this section, as shown on FIG. 2. Therefore, an occupied track electrical power $P_{OT}$ is consumed by the electrical circuit 3A until the train T exits this section.

At time T0, the occupied track power $P_{OT}$ is equal to an initial value P1 which is the necessary power to provoke sufficient current variations adapted to be detected by the reception device 11A while the train T runs through the corresponding track section 1A, and is superior to the power-saving value P0. This power management allows saving power when no train is running on the railway track 1. The electrical power consumed by the electrical circuit 3A depends on the position of the train T on the track section 1A and notably on the distance between the train T and the transmission device 9A. Indeed, as the train T approaches the transmission device 9A, electrical resistance of the electrical circuit 3A progressively decreases as the length of rails 1A1 and 1A2 in which current circulates decreases.

For instance, the value P0 may be set inferior to 70% of the initial value P1, preferably inferior to 50% of the initial value P1.This value P0 can be a configuration parameter, that depends on the track circuit parameters such as length, type and a power saving factor requested; as an example a value of 50% can be used, in order to maintain track circuit operation.

After T0, as the train T approaches the transmission device 9A, electrical resistance of the electrical circuit 3A progressively decreases as the length of rails 1A1 and 1A2 in which current circulates decreases. The occupied track power $P_{OT}$ of the electrical circuit 3A therefore progressively rises and would reach a significantly high value P3, which corresponds to the instant when the train T passes the transmission device 9A. To further save power, the occupied track power $P_{OT}$ consumed by the electrical circuit 3A when a train T is detected is kept under a limited value P2, as shown on FIG. 2. When this limited power value P2 is reached by the power consumption, at a time T1, the transmission device 9A is commanded to control the nominal electrical power PN applied to the electrical circuit so that the power consumption of the electrical circuit, i.e. the occupied track power, remains steady at the limited value P2. In other words, the transmission device 9A, and for example the tension applied to the electrical circuit 3A, is commanded using the algorithm of the present invention so that the power consumption of the electrical circuit 3A remains steady at the limited value P2.

This allows a consumption reduction, with respect to the value the occupied track power $P_{OT}$ would reach if not controlled. In particular, power value P2 is chosen inferior to the maximal value P3 that the power consumption would reach when the train T passes the transmission device 9A. For instance, the limited value P2 may be set to inferior to 70%, preferably inferior to 50% of the maximal value P3. This value can be a configuration parameter, that depends on the track circuit parameters such as length, type and a power saving factor requested; as an example a value of 50% can be used, in order to maintain track circuit operation.

At a time T2, the train T is detected as leaving the track section 1A, and the transmission device 9A is still commanded to deliver the nominal electrical power PN. This is detected by the reception device 11A when the electrical intensity returns to a value that denotes that the electrical current again circulates up to the reception device 11A. At time T2, the free track electrical power PF, consumed by the electrical circuit 3A corresponds to the power consumption of the electrical circuit 3A when the transmission device 9A is controlled to deliver the nominal electrical power PN and no train is present on the track section 1A. As presented on FIG. 2, at time T2 the free track electrical power PF is maintained at a security value P4 inferior to the track occupied electrical power $P_{OT}$, and notably inferior to the initial power P1 and superior to the power saving value P0. In order to guarantee that the train T has exited the track section 1A, and that no other train follows, a delay d is set before the transmission device 9A is controlled to deliver the minimal electrical power equal to the power saving value P0. If at time T3, when the delay d expires, no other train has been detected on the track section 1A, the transmission device 9A is controlled to deliver the minimal electrical power and the free track power PF is set back to the power saving value P0.

The delay d is adjustable and is preferably superior to 30 seconds. As an example, the delay d can be set to 1 minute and it can be adjusted following signaling users needs.

Alternatively the delay d is approximately equal to 0 seconds.

The power consumption of the electrical circuits 3A and 3B depends on the position of the train on the track sections. More especially, the current through the electrical circuits 3A, 3B varies according to the position of the train.

The power consumption of the electrical circuits 3A and 3B is, for example, controlled by varying the tension delivered by the transmission devices 9A and 9B. This can be implemented using control boxes 15A and 15B, which are connected to the power line 7, and which control the amount of tension fed to the transmission devices 9A and 9B. For example, the control boxes 15A and 15B may be adapted to receive the signals 13A and 13B emitted by the reception devices 11A and 11B and be adapted to control the tension delivered by the transmission devices 9A and 9B on the basis of the information delivered in the signals 13A and 13B.

Generally speaking, the nominal electric power PN delivered between T0 and T3 is adjusted so that the power consumption of the electrical circuit successively takes the values P1, P2 and P4.

Alternatively, the power consumption of the electrical circuits 3A and 3B is controlled by varying the current delivered by the transmission devices 9A and 9B.

The signals 13A and 13B are, for example, transmitted through cable respectively linking the reception device 11A and the control box 15A, and the reception device 11B and the control box 15B.

Alternatively, a wireless communication is used between the reception device 11A and the control box 15A and between the reception device 11B and the control box 15B, to transmit the signals 13A and 13B.

The invention claimed is:

1. A method for managing a railway electrical circuit adapted to detect presence of a train rolling on a railway track formed by two rails, the railway track being subdivided in successive track sections forming successive electrical circuits independently fed with an electrical current for monitoring the presence of the train rolling on one of the track sections, each electrical circuit comprising a transmission device electrically connected to the two rails for feeding the electrical circuit with the electrical current, located at one end of the track section, and a reception device for detecting the electrical current circulating in the electrical circuit, located at an opposed end of the track section, this method comprising:

a) continuously feeding, by a control box connected to the transmission device, the electrical circuit with the electrical current corresponding to a minimal electrical power with the transmission device and monitoring the presence of the train on the corresponding track section by measuring, using the reception device, the current circulating in the electrical circuit;

b) if the reception device detects a reduction of the current circulating in the electrical circuit denoting that the train is present on the corresponding track section and induces a short-circuit between the two rails by the train, applying, by the control box, to the electrical circuit, with the transmission device, a nominal electrical power at least until the train exits the corresponding track section;

c) if the reception device detects that no train is present on the corresponding track section, applying, by the control box, to the electrical circuit, with the transmission device, the minimal electrical power having a power-saving power value which is inferior to the nominal electrical power;

wherein at b) the electrical power consumed by the electrical circuit of the corresponding track section when the train is present is kept under a limited value, corresponding to the nominal electrical power, by the transmission device, commanded by the control box adapted to receive signals from the reception device containing information on the current circulating in the electrical circuit so as to prevent increase of the power consumption of the electrical circuit to a maximum power value due to the advancing of the train towards the end associated with the transmission device.

2. The method according to claim 1, wherein the limited power value is less than 70% of the maximal power value.

3. The method according to claim 2, wherein the limited power value is set to be less than 50% of the maximal power value.

4. The method according to claim 1, wherein the power-saving power value is set at less than 70% of an initial power value, the initial power value corresponding to the power consumed by the electrical circuit at the instant the reception device detects that the train is present on the corresponding track section, and the nominal electrical power is applied to the electrical circuit.

5. The method according to claim 4, wherein the power-saving power value is less than 50% of the initial power value.

6. The method according to claim 1, wherein during b) a delay is set when the train is detected as having exited the railway track section, and wherein if the delay expires while no other train has been detected on the track section, c) is executed.

7. The method according to claim 6, wherein the delay is adjustable.

8. The method according to claim 6, wherein the delay is superior to 30 seconds.

9. The method according to claim 8, wherein the delay is set to 1 minute.

10. A system for detecting presence of a train rolling on a railway track formed by two rails, the railway track being subdivided in successive track sections forming successive electrical circuits independently fed with an electrical current for monitoring the presence of the train rolling on one of the track sections, comprising:

a transmission device electrically connected to the two rails for feeding the corresponding electrical circuit with the electrical current, located at one end of the track section, and a reception device for detecting the electrical current circulating in the electrical circuit, located at an opposed end of the corresponding track section, the transmission device being adapted to continuously feed the corresponding electrical circuit with the electrical current corresponding to a minimal electrical power, the reception device being adapted to monitor the presence of the train on the corresponding track section by measuring the current circulating in the corresponding electrical circuit, the transmission device being adapted to apply to the corresponding electrical circuit a nominal electrical power if the corresponding reception device detects a reduction of the current circulating in the electrical circuit, denoting that the train is present on the corresponding track section and induces a short-circuit between the two rails by the train, at least until the train exits the corresponding track section, the transmission device being adapted to apply to the corresponding electrical circuit the minimal electrical power having a power-saving power value, which is inferior to the nominal power, if the corresponding reception device detects that no train is present on the corresponding track section, wherein the transmission device keeps the electrical power consumed by the electrical circuit of the corresponding track section when the train is present under a limited value when the nominal electrical power is applied to this electrical circuit, wherein the reception device is adapted to emit signals containing information denoting the presence or absence of the train, on the current circulating in the electrical circuit, and wherein the system comprises at least one control box adapted to receive the signals from the reception device and which controls the current delivered by the transmission device on the basis of the information on the current circulating in the electrical circuit contained in the signals so as to prevent increase of the power consumption of the electrical circuit to a maximum power value due to the advancing of the train towards the end associated with the transmission device.

* * * * *